US006266608B1

(12) United States Patent
Pertz

(10) Patent No.: US 6,266,608 B1
(45) Date of Patent: Jul. 24, 2001

(54) METHOD AND APPARATUS FOR THE SELECTION OF TRAFFIC INFORMATION FOR A MOTOR VEHICLE

(75) Inventor: Uwe Pertz, Bergheim (DE)

(73) Assignee: Nokia Mobile Phones Limited, Espoo (FI)

( * ) Notice: Subject to any disclaimer, the term of this patent is extended or adjusted under 35 U.S.C. 154(b) by 0 days.

(21) Appl. No.: 09/417,565

(22) Filed: Oct. 14, 1999

(51) Int. Cl.[7] ..... G08G 1/09

(52) U.S. Cl. ..... 701/200; 701/117; 340/901; 342/454

(58) Field of Search ..... 701/200, 117, 701/118, 119; 340/901, 905; 342/454, 456

(56) References Cited

U.S. PATENT DOCUMENTS 5,731,978 * 3/1998 Tamai et al. ..... 364/444.1
5,812,069 * 9/1998 Albrecht et al. ..... 340/905
5,948,040 * 8/1999 DeLorme et al. ..... 701/201
5,987,374 * 11/1999 Akutsu et al. ..... 701/117
5,999,877 * 12/1999 Takahashi et al. ..... 701/117
6,008,741 * 12/1999 Shinagawa et al. ..... 340/90
6,012,012 * 1/2000 Fleck et al. ..... 701/117

FOREIGN PATENT DOCUMENTS 0 756 153 A2 1/1997 (EP) .

* cited by examiner

*Primary Examiner*—William A. Cuchlinski, Jr.
*Assistant Examiner*—Olga Hernandez
(74) *Attorney, Agent, or Firm*—Perman & Green, LLP

(57) ABSTRACT

When a motor vehicle (1) is being driven, traffic information (5) which relates exclusively to its individual route of travel can be transmitted to the vehicle driver. Traffic information which does not apply to this area is suppressed. The traffic information is selected automatically and as a function of a time-dependent movement profile of the motor vehicle. The respective areas for which traffic information is desired thus no longer need be predetermined manually, so that no time-consuming setting processes are involved, and safety while driving is increased.

14 Claims, 2 Drawing Sheets

METHOD AND APPARATUS FOR THE SELECTION OF TRAFFIC INFORMATION FOR A MOTOR VEHICLE

The invention relates to a method and an apparatus for the selection of traffic information for a motor vehicle. Such a method and such an apparatus are already generally known. According to the conventional prior art, the driver of a motor vehicle can report, before he starts a journey, the geographical area for which he desires traffic information to a telematics terminal installed in the motor vehicle. To do this, appropriate information must be input manually into the telematics terminal, for example to the effect that the driver wishes to move only within a town in the future or intends, for example, to drive to a more distant destination on a cross-country route or motorway. In the first-mentioned case, the only traffic information which is indicated or reported to him is that which is relevant for a circular area with a predetermined radius around the motor vehicle. In this case, the driver can himself also define the size of the radius. In contrast, in the last-mentioned case, the driver is given only traffic information which applies to a predetermined area around the motor vehicle and for that area in which the motor vehicle is moving in the direction of the destination. In the second case, the area for which relevant traffic information is obtained has a shape similar to that of a keyhole. Once again, radii and distances may be freely chosen by the driver before he starts the journey, or may be predetermined by the system.

A disadvantage of the known method is that, before starting to drive, the driver must himself select the respective areas for which he desires traffic information. To do this, suitable filter parameters must be input into the telematics terminal, which filter parameters are used to filter out from a large set of traffic information only those items which relate to the area selected by the driver. With the continuously increasing number of electronic devices in a motor vehicle, the additional process of manually inputting filter parameters for the selection of traffic information is, however, undesirable since this represents an additional load on the driver and, in some circumstances, could distract him if he were making a setting while driving.

EP 0 789 343 A1 has already disclosed a method for the selection of received traffic information or traffic information to be transmitted in a vehicle, in which case the selection is carried out as a function of the type of road on which the vehicle is currently being driven. In this case, the geometric journey route is defined section-by-section in the vehicle, with the details relating to the respective section of the geometric journey route comprising at least the relative positions of the start point and end point of this section, and this section of the journey route being compared with characteristic, geometric variables relating to road types, from which the road type currently being driven on is defined, and is used as a selection criterion. A characteristic feature in this case is, however, the fact that no time analyses are required, and only geometric details relating to the journey route are considered.

The invention is based on the object of developing a method and an apparatus of the type mentioned initially such that it is possible to select areas for which traffic information is desired more easily and in a less time-consuming manner, but nevertheless highly accurately.

The solution to the described object with respect to the method is specified in Claim 1. In contrast, a solution to the stated object with regard to the apparatus is contained in Claim 10. Advantageous refinements of the invention can be found in the respective associated dependent claims.

In accordance with the invention, in the case of a method for the selection of traffic information for a motor vehicle, the selection is carried out automatically and as a function of a time-dependent movement profile of the motor vehicle. Thus, after starting his motor vehicle and switching on his telematics terminal, the driver need do nothing more whatsoever in order to make the selection of the respective areas for which he desires to be given traffic information, but can concentrate entirely on the road traffic, thus considerably simplifying the journey in the motor vehicle, and making it safer.

The movement profile of the motor vehicle can for this purpose be determined in various ways, for example on the one hand by means of acceleration sensors and direction sensors fitted to the motor vehicle, or on the other hand by radio position sensors, for example GPS receivers, and the like which operate in conjunction with time measurement appliances. Together with the movement profile of the motor vehicle, its actual position is then used to select the relevant traffic information, that is to say to select that area for which the driver desires traffic information.

The selection of the traffic information can be carried out, for example, directly using the telematics terminal in the motor vehicle, for example if traffic information for very large geographical areas is transmitted by public transmitters and is received by the mass of those driving in the traffic. In this case, the traffic information which applies to the very large geographical areas is temporarily stored in a traffic information memory which belongs to the telematics terminal in the motor vehicle, and is updated, or changed to the latest state, with each transmission cycle of the public transmitters. The traffic information relevant to the driver is then filtered out or selected from this traffic information temporarily stored in this way, as a function of the movement profile of the motor vehicle, to be precise as a function of filter parameters which are generated on the basis of the movement profile of the motor vehicle.

If, on the other hand, the traffic information for a desired area is transmitted by a service provider on request by an individual person driving in the traffic, then the selection of traffic information could also be carried out by the service provider, so that only a small amount of information now need be transmitted to the requesting person driving in the traffic, thus reducing his user costs, and reducing the memory space required in the telematics terminal. However, to do this, the requesting person driving in the traffic must previously have transmitted to the service provider his current position and the filter parameters derived from the movement profile of his motor vehicle.

According to one refinement of the invention, the selection of traffic information can be carried out, for example, as a function of the speed of the motor vehicle. If the motor vehicle is moving at a relatively low speed and below a predetermined speed value, then the filter parameters are automatically chosen such that the traffic information is transmitted to the driver only for a circular area around the motor vehicle. If, on the other hand, the speed of the motor vehicle is above the predetermined speed value, then the selection is made such that the driver is provided only with traffic information for a relatively narrow area extending in the direction of travel of the vehicle.

According to one development of the invention, the selection may also be carried out as a function of changes in the direction of travel of the motor vehicle. If the motor vehicle is travelling at a relatively low mean speed and relatively high mean direction changes in the direction of travel occur at the same time, then it is assumed that the motor vehicle is staying within a town area. In this case, the area for which traffic information is to be transmitted to the driver is placed in a circular shape around the motor vehicle, to be precise with a relatively small radius. If, on the other hand, the motor vehicle is moving at a relatively high mean speed (above the predetermined speed value) and relatively minor mean direction changes in the direction of travel of the motor vehicle occur at the same time, then it is assumed that the motor vehicle is moving on a high-speed road or motorway in the direction of a more distant destination. In this case, the filter parameters are selected and generated such that the area relevant for traffic information extends to the destination in the direction of the journey route, as already mentioned above.

When the motor vehicle is started, no movement profile of the motor vehicle is generally available, so that traffic information is then automatically selected from a circular area having a predetermined radius around the motor vehicle, with the radius being relatively large in this case. Once the movement profile of the motor vehicle has been recorded, the radius can then be correspondingly reduced if the motor vehicle remains in a town area, or the relevant area for traffic information is extended in the form of a tube in the direction of a more distant destination, if the movement profile of the motor vehicle changes in an appropriate manner.

Speeds as well as changes in the direction of travel of the motor vehicle are preferably in each case determined at predetermined time intervals, in order to keep the traffic information selection as up-to-date as possible. First, with respect to these time intervals, new filter parameters are in each case generated on the basis of the mean speed and direction values obtained in each case in the said time intervals, thus ensuring that the selection method has a certain intrinsic dynamic characteristic. On the one hand, up-to-date traffic information related to the motor vehicle's location can be filtered out and selected continuously on the basis of the filter parameters applicable to the respective time intervals while, on the other hand, the traffic information stored in the traffic information memory can always be brought to the latest state, and can be overwritten as appropriate.

An apparatus for the selection of traffic information for a motor vehicle contains a filter device which passes traffic information only for a predetermined geographical area, depending on filter parameters; a filter parameter production device for automatically producing the filter parameters as a function of a time-dependent movement profile of the motor vehicle; and an output device for outputting the traffic information which has been passed.

Such an apparatus may be located, for example, in a telematics terminal which is installed in a motor vehicle. In the case of the telematics terminal, the filter parameter production device would then be connected on the input side to a device for supplying the movement profile of the motor vehicle, in which case this device, for example, transmits the speed and direction of travel, and, if required, mean values derived from them as well, to the filter parameter production device. The output device would then be a visual or audible indicator device for transmitting the selected traffic information to the driver of the motor vehicle. At the same time, the filter device could be connected to a memory device on the input side, for storing received traffic information.

If, on the other hand, the apparatus were to be arranged at the transmitter end, then a receiver would be connected to the filter parameter production device, which receiver receives the movement profile of the motor vehicle and transmits it to the filter parameter production device. The output device would then be a transmitter device, in order to transmit the selected traffic information to the requesting motor vehicle. The filter parameter production device could in this case alternatively be accommodated in the motor vehicle, so that only the filter parameters would then need to be transmitted to the filter device at the transmission end.

An exemplary embodiment of the invention is explained in more detail in the following text with reference to the drawing, in which.

Figure 1:
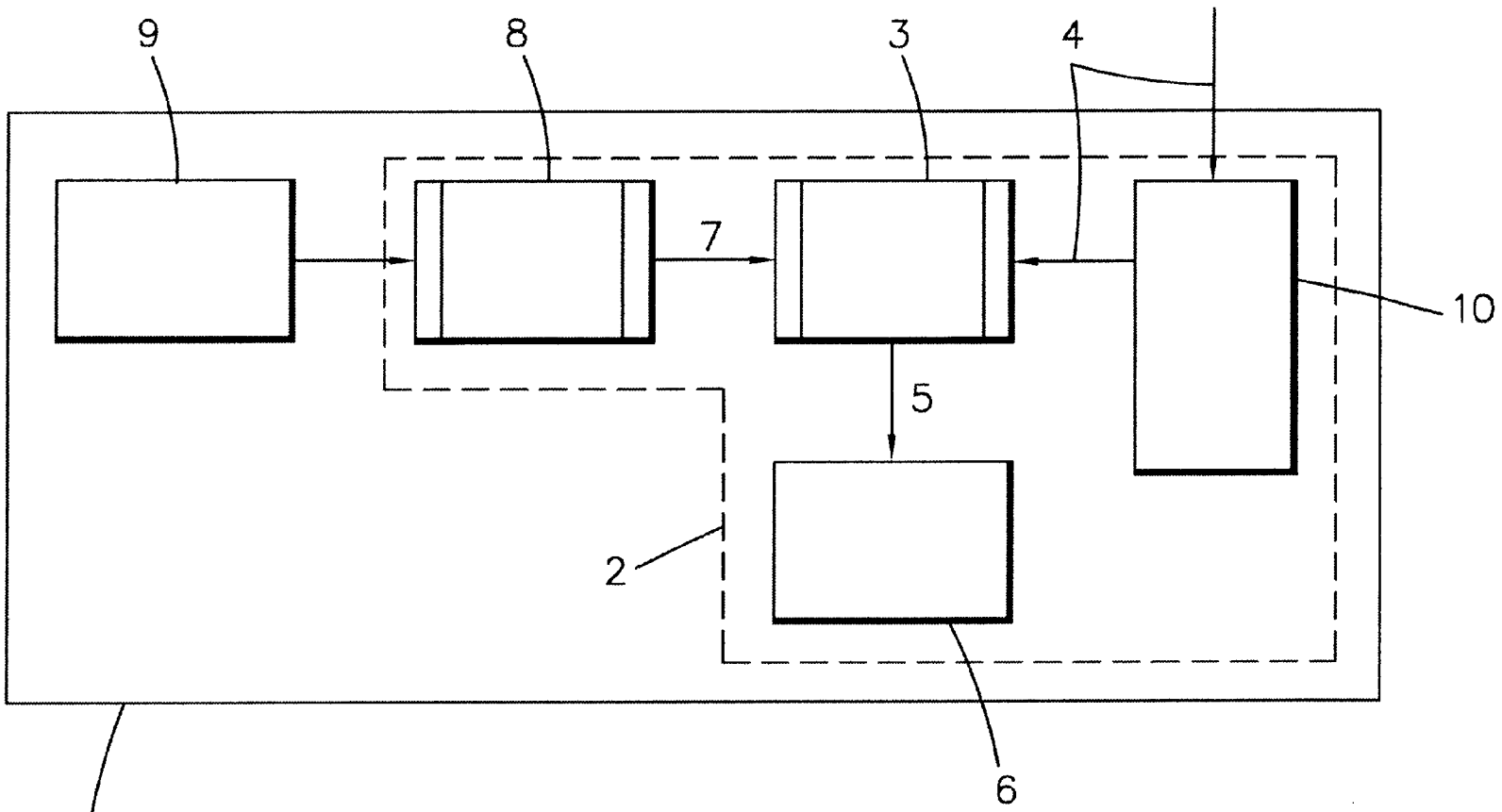
FIG. 1 shows a block diagram of an apparatus for the selection of traffic information, which is installed in a motor vehicle.

Corresponding to FIG. 1, a telematics terminal 2 is located within a motor vehicle 1, with only those blocks of the telematics terminal 2 which are relevant to the invention being shown. The telematics terminal 2 includes a filter device 3, which uses filter parameters to filter traffic information 4 supplied to it. Filtered traffic information 5 is then passed to an output device 6, which is connected on the output side to the filter device 3 and is used to output the filtered traffic information 5, for example visually or audibly.

The manner in which the traffic information 4 supplied to the filter device 3 is filtered depends on filter parameters 7 which are output from a filter parameter production device 8 and are transmitted to the filter device 3. These filter parameters 7 are inserted in a filter algorithm, which is carried out by the filter device 3 in order to filter the traffic information 4. The traffic information 4 is in the form of coded information such that it includes details about the location in which it applies. The traffic information 4 is temporarily stored in a traffic information memory 10, in which continually updated traffic information 4 from, for example, public transmitters is newly stored, with traffic information which is no longer valid being deleted and/or overwritten.

On the input side, a device 9 for supplying a movement profile of a motor vehicle 1 is connected to the filter parameter production device 8. This device 9 may be, for example, one which detects the movement profile of the motor vehicle 1 directly, that is to say it is local. It need not detect the absolute position of the vehicle. Other devices are available for this purpose, for example a GPS receiver or the like. In fact, it is sufficient for the device 9 to detect only the current direction and speed values of the motor vehicle. The filter parameter production device 8 then selects the associated filter parameters 7, for example using a suitable table, from these direction and speed values, from which mean directions and speed values can also be determined.

The method of operation of the apparatus described in FIG. 1 will be described in detail in the following text. This will be done with reference to FIGS. 2 and 3.

When the driver enters his motor vehicle 1 and wishes to obtain traffic information related to his individual journey route, for example from a transmitting station which regularly transmits traffic information that is applicable to a very large geographical area to the mass of those driving in the traffic, then he just needs to start his vehicle and start the journey, which results in the apparatus according to the invention being initialized. Even after a short time, he is provided with the first filtered traffic information, which is indicated on the output device 6, for example.

Without filtering, traffic information would be transmitted to him which would apply to an area with a radius of, for example, 100 km around his motor vehicle. However, according to the invention, the only traffic information 5 transmitted to him is that which has been obtained by filtering the received traffic information 4 and which applies to that area in which the vehicle is also actually moving. The filter algorithm carried out by the filter device 3 operates dynamically and continually improves itself, so that the quality of the filter result increases as the time for which the motor vehicle has been driven increases.

Figure 2:
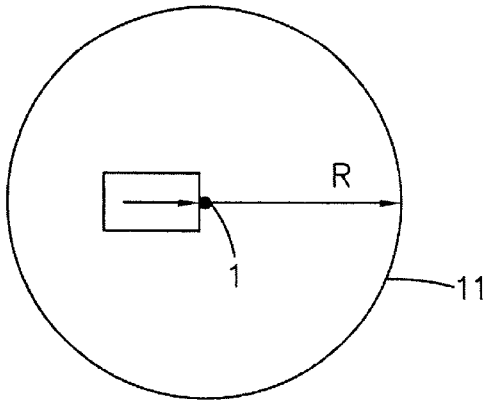
FIG. 2 shows an area for relevant traffic information selected when the motor vehicle is started.

Shortly after the motor vehicle has been started, there is still no measurement data available from the device 9, so that the filter parameters 7 are first of all set to a predetermined initial value. This initial value characterizes a circular area 11 around the motor vehicle 1, and has a predetermined radius R, as shown in FIG. 2. All the received traffic information 4 is in this case filtered with the aid of the filter device 3. The predetermined radius R in this case has a mean size of, for example, 50 km since, at this time, no accurate knowledge is yet available as to whether the motor vehicle is moving only locally or a long-distance journey is intended.

Figure 3:
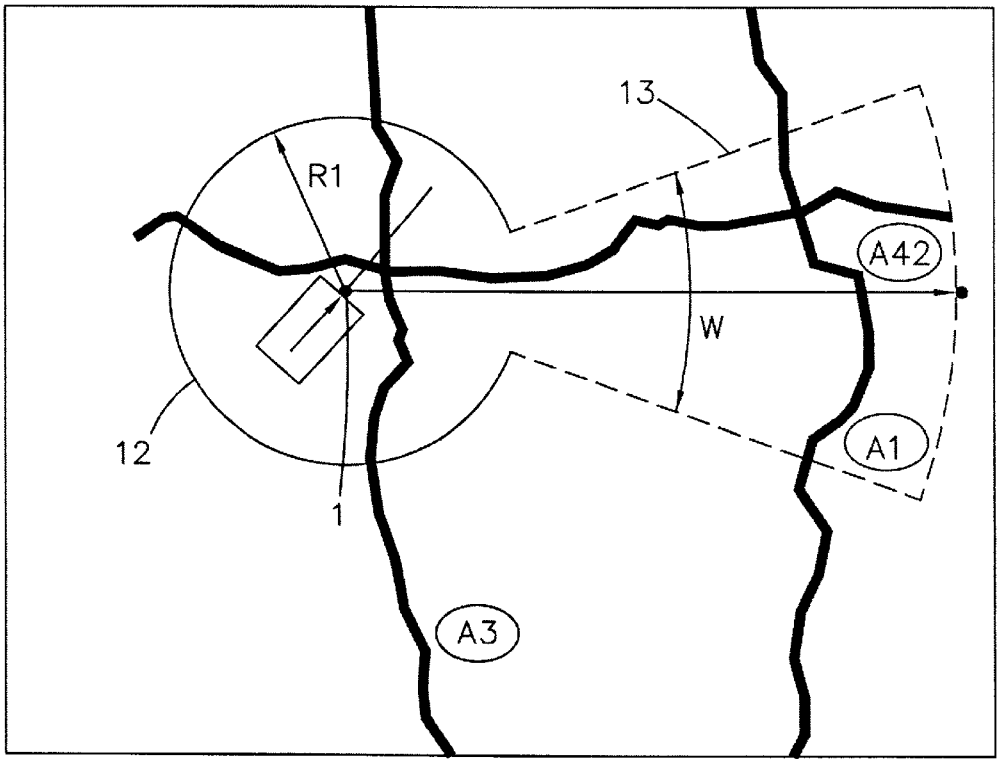
FIG. 3 shows currently selected areas for relevant traffic information when the motor vehicle is being driven to a more distant destination.

Once the vehicle has been driven for a short time, the device 9 supplies the first movement data to the filter parameter production device 8. If, for example, the vehicle is being driven at a relatively low mean speed and relatively high mean direction changes occur, then these measured values are used in the filter parameter production device 8 to establish that the vehicle is located within a city area. As a consequence of this, the filter parameters 7 are set appropriately, to be precise to a circle 12 around the motor vehicle with a radius R1 which is, for example, approximately 25 km, as can be seen in FIG. 3. This may be a minimum radius. As long as neither the mean speed nor the mean direction error changes, the driver of the motor vehicle is thus transmitted only traffic information which relates exclusively to this small area 12. Traffic information 4 for areas outside this circular area is suppressed; however, it remains stored in the traffic information memory 10 until it is overwritten.

If, on the other hand, the mean vehicle speed is relatively high (above a predetermined mean speed value), and if the mean direction error is relatively small or is less than a predetermined mean direction error, then suitable different filter parameters 7 are selected by the filter parameter production device 8, in order to receive the traffic information only for an area which essentially extends in what is now the mean valid direction of travel of the vehicle. This is the area 13 in FIG. 3. In addition to this, information for the area 12 is also transmitted to the driver. Overall, the filter parameters 7 are thus set such that information for the areas 12 and 13 shown in FIG. 3 is obtained, that is to say for an area essentially in the shape of a keyhole. The total area 12, 13 is essentially characterized by the radius R1, the mean or estimated direction of travel, and an estimated or predetermined opening angle W related to this mean direction of travel.

According to the invention, the selection of the traffic information is carried out repeatedly, in which case the corresponding data related to the speed and the direction error can in each case be collected over a time period of about 10 minutes, in order to obtain the mean values from them. The minimum time interval for selection can thus be even 10 minutes or more, so that, for example, when driving on a motorway, the keyhole-shaped area structure 11, 12 is generated repeatedly. The filter parameters are thus generated repeatedly, in order continuously to provide the capability of being able to transmit to the driver traffic information related to the respective location of the motor vehicle.

What is claimed is:

1. An apparatus for a selection of traffic information for a motor vehicle (1), having:

a filter device (3) which, depending on filter parameters (7), passes traffic information (4) only for a predetermined geographical area;

a filter parameter production device (8) for automatically producing the filter parameters (7) as a function of a time-dependent movement profile of the motor vehicle (1); and an output device (6) for outputting the traffic information (5) which has been passed.

2. Apparatus according to claim 1, characterized in that the filter device (3) is connected to a traffic information memory (10) in which traffic information (4) can be stored.

3. Apparatus according to claim 1, wherein the filter parameter production device (8) is connected on an input side to a device (9) for supplying a speed and a direction of travel of the motor vehicle (1).

4. The apparatus of claim 1 wherein the filter parameter production device is further adapted to produce the filter parameters only a as a function of an actual position and a time dependent movement profile of the motor vehicle.

5. A method for selecting traffic information (4) for a motor vehicle (1) comprising the steps of:

storing traffic information for a first geographical area comprising an actual position of the motor vehicle;

selecting from the first geographical area a second geographical area (11, 12, 13) for which traffic information is desired, wherein the second geographical area (11, 12, 13) is selected only in dependence of the actual position and a movement profile of the motor vehicle (1); and filtering out from the traffic information for the first geographical area a second traffic information set that is valid for the second geographical area (11, 12, 13).

6. The method according to claim 5, wherein the movement profile is a function of the speed of the motor vehicle (1).

7. The method according to claim 5, wherein the movement profile is a function of changes in a direction of travel of the motor vehicle (1).

8. The method according to claim 7 further comprising the step that, if a mean speed of the motor vehicle (1) is high and a mean change in the direction of travel of the motor vehicle is low, traffic information is selected only with respect to an area (12, 13) located in the direction of travel.

9. A method of automatically selecting traffic information for a motor vehicle comprising the steps of:

starting the motor vehicle; and selecting traffic information from a first circular area (11) having a predetermined radius (R), wherein the traffic information is selected as a function of a time-dependent movement profile of the motor vehicle.

10. The method according to claim 9, that, further comprising the step that if a mean speed of the motor vehicle (1) is low and a mean change in a direction of travel of the motor vehicle is high, a radius (R1) of a second circular area (12) is either kept constant or is set to a lower value.

11. The method according to claim 5, further comprising the step of:

determining a speed of the motor vehicle and a change in a direction of travel of the motor vehicle in a predetermined time interval.

12. The method according to claim 5 wherein the storing of the traffic information is carried out in a telematics terminal (2) installed in the motor vehicle (1).

13. The method according to claim 5, wherein the filtering of the traffic information is carried out at a transmitter end of a traffic information selection apparatus.

14. The method of claim 5 wherein the step of selecting is carried out automatically as a function of a time independent movement profile of the motor vehicle.

* * * * *